US009115513B1

(12) United States Patent
Cayouette

(10) Patent No.: US 9,115,513 B1
(45) Date of Patent: Aug. 25, 2015

(54) SECURABLE LOCKING CLIP

(71) Applicant: Yves Cayouette, Moonbaem (CA)

(72) Inventor: Yves Cayouette, Moonbaem (CA)

( * ) Notice: Subject to any disclaimer, the term of this patent is extended or adjusted under 35 U.S.C. 154(b) by 284 days.

(21) Appl. No.: 13/731,243

(22) Filed: Dec. 31, 2012

(51) Int. Cl.
*E05B 73/00* (2006.01)

(52) U.S. Cl.
CPC ..... *E05B 73/0005* (2013.01)

(58) Field of Classification Search
USPC ..... 24/537; 70/15
See application file for complete search history.

(56) References Cited

U.S. PATENT DOCUMENTS

| | | | | |
|---|---|---|---|---|
| 1,276,125 | A | 8/1918 | Sherburne et al. | |
| 1,374,595 | A | 4/1921 | McDonald | |
| 2,039,620 | A | 5/1936 | Bear | |
| 4,901,406 | A | 2/1990 | Shelby et al. | |
| 5,116,014 | A | 5/1992 | Slavens et al. | |
| 5,706,680 | A * | 1/1998 | Wroble | 70/18 |
| 6,698,071 | B1 * | 3/2004 | Greer et al. | 24/537 |
| 2007/0220717 | A1 | 9/2007 | Brinson | |

* cited by examiner

*Primary Examiner* — Jack W Lavinder
(74) *Attorney, Agent, or Firm* — Robert C. Montgomery; Montgomery Patent & Design, LLC

(57) ABSTRACT

A security device to prevent the theft of personal items comprises a plastic clip with an adjustable movable hasp on a first end and interlocking gripping teeth on an opposing second end. The movable hasp squeezes the jaws together and prevents their opening. The hasp is in turn held in place by a padlock which can secure the device to a stationary object such as a beach chair, post, table, or similar item using a flexible cable.

17 Claims, 4 Drawing Sheets

SECURABLE LOCKING CLIP

RELATED APPLICATIONS

There are no current co-pending applications.

FIELD OF THE INVENTION

The presently disclosed subject matter is directed toward security devices. More particularly, the present invention relates to security devices for preventing personal items such as purses, clothing, luggage, or the like from being stolen or moved while sitting unattended.

BACKGROUND OF THE INVENTION

Very few leisure time activities rival that of spending warm summer days at the beach. Some enjoy being around a pool with all the comforts of home, while others spend time outside tanning. Whatever the reason, all of these events share common items such as beach towels, beach bags, clothing, or the like. However, when a person wishes to go into the water or otherwise walk away for a few short moments, one runs the risk of having their personal items stolen.

Even if they are not stolen, they can be picked up by someone else and moved to another location where they cannot be easily found. Similar difficulties appear when traveling and personal items such as coats, jackets, luggage, or the like must be left alone for short periods of time.

Accordingly, there exists a need for a means by which easily movable or stolen items can be easily secured against theft or unauthorized movement.

SUMMARY OF THE INVENTION

The principles of the present invention provide for a securable locking clip that can grasp items such as towels, clothing, purses, luggage, or the like in its clasping jaws/or by using a flexible secure cable. The securable locking clip can then be attached to a stationary object to prevent a person from taking or moving the items.

The securable clip is a lock suitable for preventing the theft, loss, or misplacing of beach towels, luggage, purses, or other personal items. One (1) end of the securable clip is hinged and receives a flexible wire cable, while the opposite end has interlocking jaws that can grip a towel or similar item. The securable clip has a movable hasp which squeezes the jaws together and prevents their opening. The hasp is held in place by a conventional padlock which can be secured to a stationary object such as a beach chair, post, table, or similar item using the flexible wire cable. In addition, various items such as purses, luggage, briefcases and the like can be secured in place by passing the flexible steel cable through the handle of the item and then securing it to a stationary object. Additionally, the securable clip can have a label for providing information such as owner's name, room number, and telephone number.

A securable clip in accord with the present invention includes a "C"-shaped clip having a hinge at one (1) end, an upper jaw extending from the hinge and a lower jaw extending the hinge. The upper and lower jaws are biased open by the hinge and they both include a tapered section located adjacent the hinge. The upper jaw and lower jaws also include clamping teeth. Force applied to the tapered section can force the upper jaw and lower jaw closed. The upper jaw also includes latching teeth on an outer surface. The securable clip also includes an adjustable band that is dimensioned to fit over the hinge and to apply a force that closes the jaws when the adjustable band is moved along the tapered section. The adjustable band including an integral hasp having an actuator tab and a locking tip. When the locking tip engages a latching tooth it secures the upper jaw and lower jaw closed.

Beneficially the clip is a molded plastic structure, the adjustable band is hollow and forms a rectangular inner opening, and the upper jaw and lower jaw include aligned padlock apertures. Also beneficially the actuator tab can pivot the locking tip out of contact with the latching tooth. A padlock for passing through the aligned apertures may also be included. A cable may also be included, preferably plastic coated and having an eyelet. An identification label may be attached, preferably on the upper jaw.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
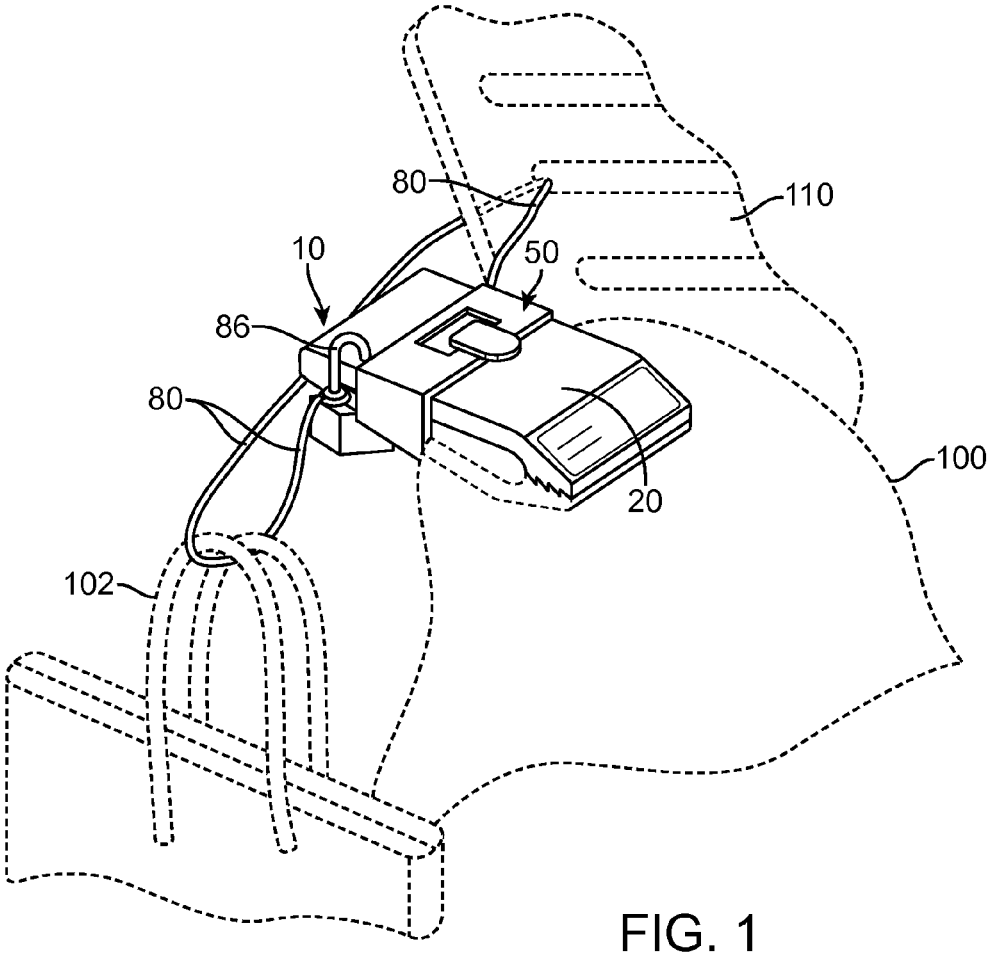
FIG. 1 is an environmental view of a securable clip assembly 10 that is in accord with a preferred embodiment of the present invention when in-use.

10 securable clip assembly
20 clip
22 hinging end portion
24 upper jaw
26 lower jaw
28 clamping tooth
30 padlock aperture
32 latching tooth
34 identification label
50 adjustable band
52 band
54 band aperture
60 clasp
62 actuator tab
64 locking tip
80 cable
82 eyelet fixture
86 padlock
87 padlock clasp
100 towel
102 personal item
110 structure

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one (1) of the referenced items.

Referring principle to FIG. 1, the preferred embodiment of the present invention is a securable clip assembly 10 that helps prevent theft of fabric-based items such as, but not limited to, beach towels 100, blankets, clothing items. The securable clip assembly 10 is also useful for securing personal items 102 such as purses, luggage, and the like to a stationary structure. The securable clip assembly 10 is especially useful in a vacation/beach environment.

Figure 2:
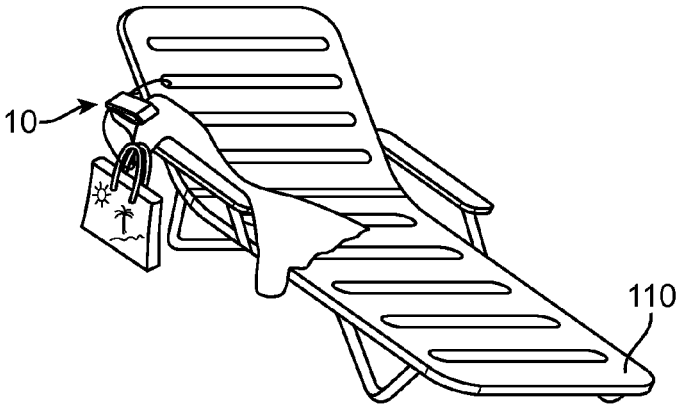
FIG. 2 is another environmental view of the securable clip assembly 10 shown in FIG. 1 when secured to a structure 110.
Figure 3:
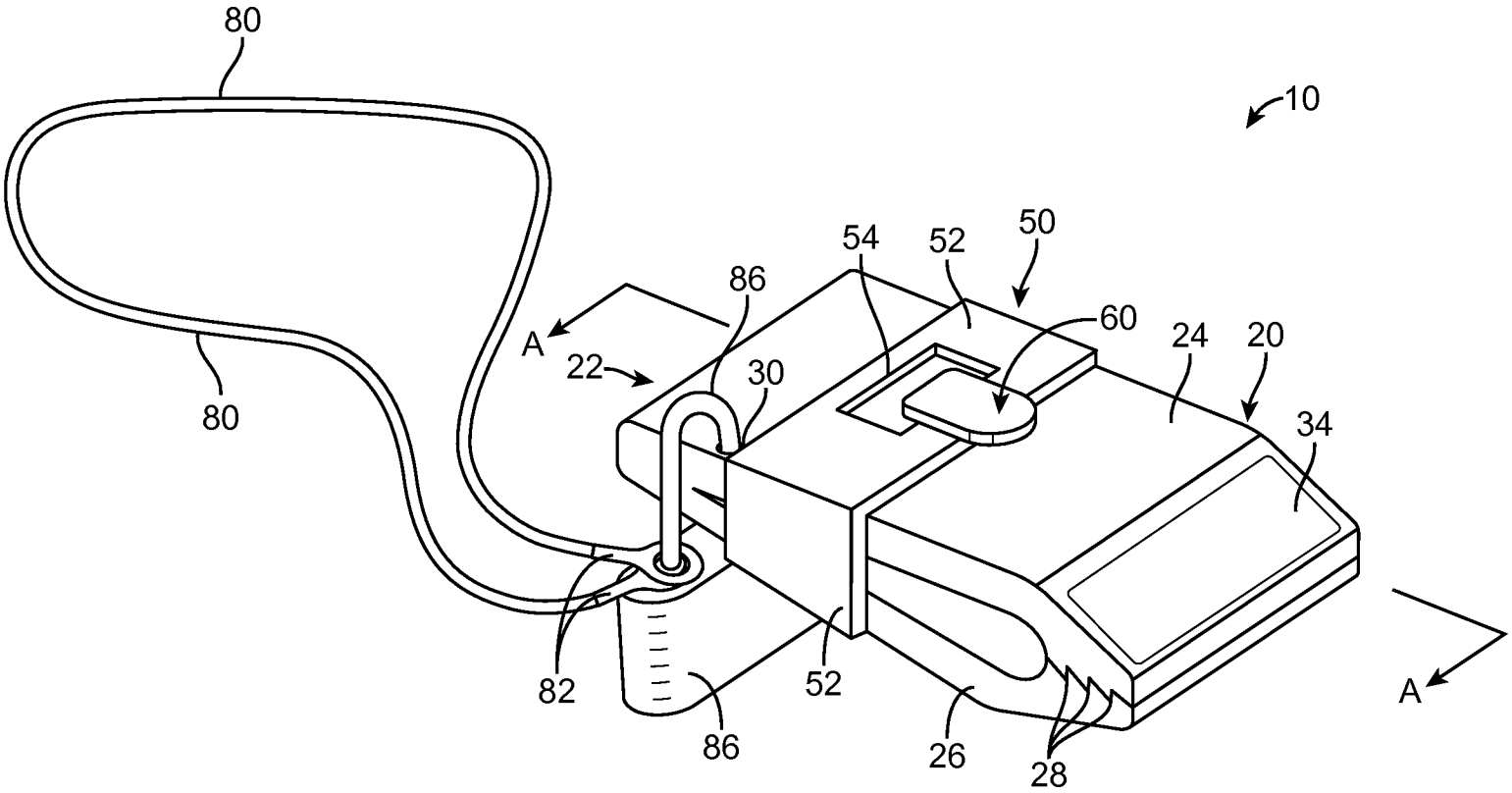
FIG. 3 is a close-up view of an assembled securable clip assembly 10 as shown in FIGS. 1 and 2.

Refer now to FIGS. 1 and 2, environmental views of the securable clip assembly 10 when in-use, and to FIG. 3, a close-up view of the securable clip assembly 10. The securable clip assembly 10 includes a clamping clip 20, an adjustable band 50, and a length of cable 80 which is secured to the clip 20 using a conventional padlock 86. The securable clip assembly 10 provides mechanical clamping forces to secure various items such as towels 100, robes, jackets, purses, suitcases, and the like to a stationary structure 110. This reduces the possibility of tampering, theft, or misplacement which increases the peace of mind of a user.

Figure 4:
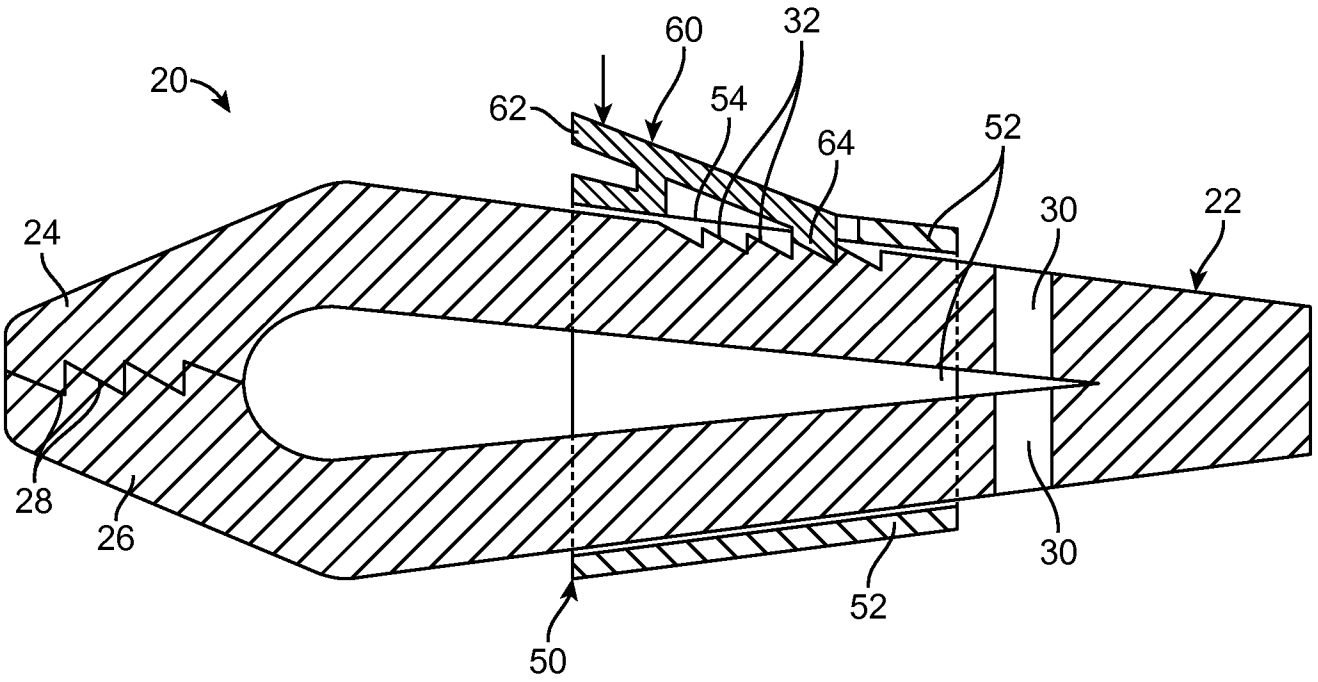
FIG. 4 is a section view of the securable clip assembly 10 taken along section line A-A of FIG. 3; and, FIG. 5 is an exploded view of the securable clip assembly 10 shown in FIGS. 1 through 4.
Figure 5:
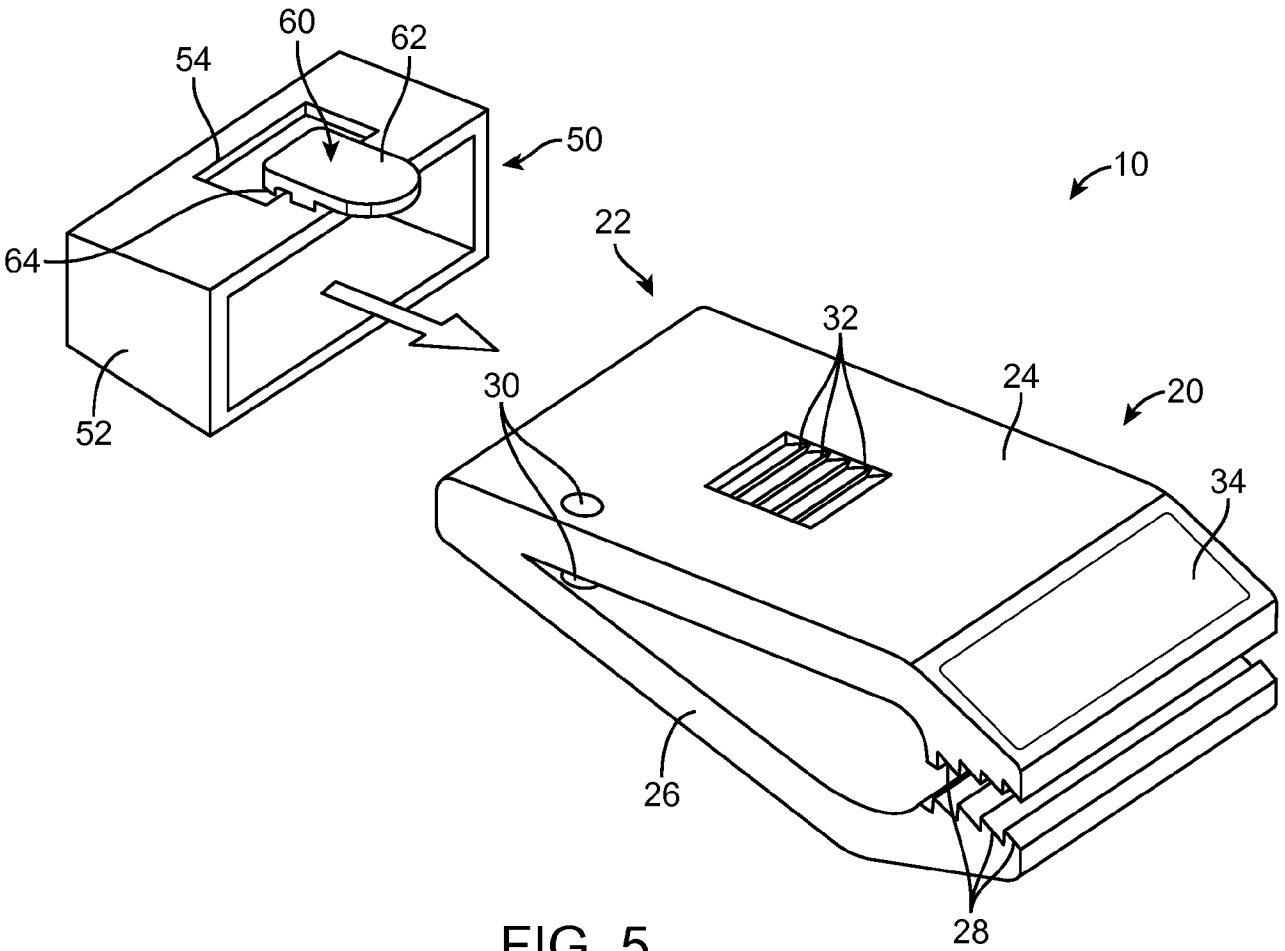

Refer now to FIGS. 3, 4, and 5, close-up, sectional, and exploded views of the securable clip assembly 10. The securable clip assembly 10 uses a generally "C"-shaped clip 20 which is approximately two-and-one-half inches (2½ in.) long and approximately one-and-one-half (1½ in.) inches wide. However, it should be understood that the actual dimensions of the securable clip assembly 10 may vary based upon a user's preference and particular applications. The clip 20 is beneficially a one-piece molded plastic structure that is envisioned as being made using an injection-molding process and as being available in a variety of colors and patterns.

The clip 20 has a molded hinge 22 at one end and a set of tapered jaws at the other. The tapered jaws includes a forward extending upper jaw 24 and a forward extending lower jaw 26 that are biased open by the hinge 22. The clip 20 is configured to have a downward tapered cross-section around the hinge 22. The upper jaw 24 and lower jaw 26 also include a plurality of clamping teeth 28 that interlock when the jaws 24, 26 are forced closed as described below. When not forced closed the upper jaw 24 and the lower jaw 26 are biased open about one inch (1 in.) by the hinge 22. This allows a user to slide a towel 100 or similar item between the open jaws 24, 26.

After the towel 100 or other item is placed between the upper jaw 24 and the lower jaw 26 those jaws 24, 26 are forced closed by sliding the adjustable band 50 forward along the tapered surfaces of the clip 20 near the hinge 22. To that end the adjustable band 50 has a hollow rectangular band section 52 that forms a rectangular inner opening that encompasses the tapered surfaces of the clip 20 near the hinge 22. As the adjustable band 50 slides forward along the clip 20 the jaws 24, 26 are forced together, thus clamping the towel 100. The adjustable band 50 is retained in a clamping position by an integral hasp 60 having a user accessible actuator tab 62 at one (1) end and a locking tip 64 at the other. The locking tip 64 engages one (1) of a plurality of latching teeth 32 that are molded into the upper jaw 24. Engagement of the locking tip 64 into one of the latching teeth 32 secures the hasp 60 in position, which secures the closing of the jaws 24, 26.

The jaws 24, 26 can be easily opened by a user depressing the actuator tab 62. This pivots the locking tip 64 out of contact with the latching teeth 32. The hasp 60 can then be rocked back and forth to slide it down the clip 20 taper. This enables the bias force of the hinge 22 to open the jaws 24, 26, releasing the item(s) placed between them.

Once the towel 100 or other item is secured within the clip 20 that clip 20 can be secured to a structure 110 (see FIG. 2) using the conventional padlock 86. To that end the clip 20 includes a pair of padlock apertures 30 that are formed through the jaws 24, 26 behind where the adjustable band 50 locks the jaws 24, 26 closed. The padlock apertures 30 are aligned and allow the padlock 86 clasp to pass through. The cable 80, preferably one (1) with a plastic-coating, has a pair of eyelets 82. The cable 80 is wrapped around or otherwise secured to the structure 110, the eyelets 82 are secured by the padlock clasp 87, the padlock clasp 87 is passed though the padlock apertures 30, and then the padlock 86 is locked.

Additionally, the clip 20 includes an identification label 34 that is affixed to a top surface of the clip 20. This enables convenient display of information such as owner's name, room number, telephone number, or the like to be applied.

It is envisioned that other styles and configurations of the present invention can be easily incorporated into the teachings of the present invention, and while only one particular configuration is shown and described that is for purposes of clarity and disclosure and not by way of limitation of scope.

The preferred embodiment of the present invention can be used by the common user in a simple and effortless manner with little or no training. After initial purchase or acquisition of the securable clip assembly 10 it would be installed as indicated in FIGS. 1 and 2.

The method of using the securable clip assembly 10 may be achieved by performing the following steps: procuring the securable clip assembly 10; removing the padlock 86 and adjustable band 50, if previously installed; inserting a towel 100 or similar item between the upper 24 and lower 26 jaws; sliding the adjustable band 52 over the hinge 22; sliding the adjustable band 52 along the tapered surfaces of the clip 20 to force the jaws 24, 26; securing the adjustable band 50 in position by allowing the locking tip 64 of the clasp 60 to engage a corresponding latching tooth 32 of the upper jaw 24; using the identification label 34 to note information such as an owner's name, room number, telephone number, or the like; wrapping or otherwise securing the cable 80 to a structure 110, securing the cable 80 to the padlock using the eyelets 82; locking the padlock 86; and then benefiting from the secure attachment of one's towel 100 or other personal property 102 to the stationary structure 110.

The cable 80 may be routed through and around suitable personal items 102 and through a stationary structure 110 such as a beach chair, and the padlock claps 87 inserted through the eyelets 82 of the cable 80, and through the padlock apertures 30 of the clip 20, thereby providing a means to securely anchor the securable clip assembly 10 and personal items 102.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A securable clip assembly, comprising:

a "C" shaped clip having a hinge at one end, an upper jaw extending from said hinge, a lower jaw extending from said hinge, and padlock apertures passing through said upper jaw and said lower jaw, wherein said upper jaw and said lower jaw are biased open by said hinge, wherein said upper jaw and said lower jaw include a tapered section adjacent said hinge, wherein said upper jaw and said lower jaw having clamping teeth, wherein said upper jaw and said lower jaw can be forced together by pressure on said tapered section, wherein said upper jaw includes latching teeth and wherein said padlock apertures are adjacent said hinge; and, an adjustable band dimensioned to fit over said hinge and to apply a force to close said upper jaw and said lower jaw when said adjustable band is moved along said tapered section, said adjustable band including an integral hasp having an actuator tab and a locking tip;

wherein said locking tip engages a latching tooth to secure said upper jaw and said lower jaw closed; and wherein a padlock passing through said padlock apertures prevents said adjustable band from moving to the hinge.

2. The securable clip assembly according to claim 1, wherein said clip is a molded plastic structure.

3. The securable clip assembly according to claim 1, wherein said adjustable band is hollow and forms a rectangular inner opening.

4. The securable clip assembly according to claim 1, wherein said actuator tab can pivot said locking tip out of contact with said latching tooth.

5. The securable clip assembly according to claim 4, further comprising a padlock for passing through said padlock apertures.

6. The securable clip assembly according to claim 1, further including a cable.

7. The securable clip assembly according to claim 6, wherein said cable includes an eyelet.

8. The securable clip assembly according to claim 7, wherein said cable is plastic-coated.

9. The securable clip assembly according to claim 1, further including an identification label.

10. The securable clip assembly according to claim 9, wherein said identification label is attached to said upper jaw.

11. A securable clip assembly, comprising:

a molded "C" shaped clip having a hinge at one end, an upper jaw and a lower jaw that extend from said hinge, wherein said upper jaw and said lower jaw are biased open by said hinge, wherein said upper jaw and said lower jaw include a tapered section adjacent said hinge, wherein said upper jaw and said lower jaw having clamping teeth, wherein said upper jaw and said lower jaw can be forced together by pressure on said tapered section, wherein said upper jaw includes latching teeth, and wherein said upper jaw and said lower jaw include aligned padlock apertures adjacent said hinge; and, an adjustable band dimensioned to fit over said hinge and to apply a force to close said upper jaw and said lower jaw when said adjustable band is moved along said tapered section, said adjustable band including an integral hasp having an actuator tab and a locking tip;

wherein said locking tip engages a latching tooth to secure said upper jaw and said lower jaw closed; and, wherein a padlock passing through said padlock apertures prevents said adjustable band from moving to the hinge.

12. The securable clip assembly according to claim 11, wherein said adjustable band forms a rectangular inner opening.

13. The securable clip assembly according to claim 12, wherein said actuator tab can pivot said locking tip out of contact with said latching tooth.

14. The securable clip assembly according to claim 13, further comprising a padlock having a clasp for passing through said padlock apertures.

15. The securable clip assembly according to claim 14, further including a cable having an eyelet configured to be received by said clasp.

16. The securable clip assembly according to claim 11, further including an identification label.

17. The securable clip assembly according to claim 16, wherein said identification label is attached to said upper jaw.

* * * * *